US006776242B1

(12) United States Patent
Cunningham

(10) Patent No.: US 6,776,242 B1
(45) Date of Patent: Aug. 17, 2004

(54) PNEUMATIC POST DRIVER

(76) Inventor: Roger Cunningham, 6983 Paddock La., Jackson, MI (US) 49201

( * ) Notice: Subject to any disclaimer, the term of this patent is extended or adjusted under 35 U.S.C. 154(b) by 0 days.

(21) Appl. No.: 10/387,142

(22) Filed: Mar. 12, 2003

Related U.S. Application Data

(60) Provisional application No. 60/364,013, filed on Mar. 13, 2002.

(51) Int. Cl.[7] ..... E21B 1/00; B25D 15/00

(52) U.S. Cl. ..... 173/90; 173/89; 173/124; 173/202; 173/132

(58) Field of Search ..... 173/90, 112, 114, 173/202, 122, 125, 204, 128, 132, 118, 89, 124, 120; 92/117 A

(56) References Cited

U.S. PATENT DOCUMENTS 2,748,750 A * 6/1956 Altschuler ..... 173/162.1
3,001,515 A * 9/1961 Haage ..... 173/125
4,665,994 A * 5/1987 Snider ..... 173/90
5,107,934 A * 4/1992 Atchison ..... 173/128
5,445,227 A * 8/1995 Heppner ..... 173/124
5,752,571 A * 5/1998 Sapozhnikov ..... 173/206
5,806,608 A * 9/1998 DuBois ..... 173/90
5,819,857 A * 10/1998 Rohrer ..... 173/90
6,050,345 A * 4/2000 Jarvinen et al. ..... 173/31
6,158,527 A * 12/2000 Juuri et al. ..... 173/128
6,347,672 B1 * 2/2002 Reardon ..... 173/90

* cited by examiner

*Primary Examiner*—Scott A. Smith
*Assistant Examiner*—Brian Nash
(74) *Attorney, Agent, or Firm*—James M. Deimen

(57) ABSTRACT

A new sign post driver comprises a piston which rests upon a post, well pipe or piling to be driven into the ground and a weighted cylinder which reciprocates vertically to impact the piston on the downstroke. The cylinder is raised pneumatically for each stroke and falls by force of gravity to strike an anvil on the piston. An optional spring assist on the downstroke adds to the impact thus adding to the impact for a given weight of cylinder. The result is an exceptionally light and simple post driver for its capabilities.

12 Claims, 2 Drawing Sheets

PNEUMATIC POST DRIVER

This application claims the benefit of provisional patent application No. 60/364,013, filed Mar. 13, 2002.

BACKGROUND OF THE INVENTION

The field of the invention pertains to devices for driving piles, sign posts and well pipes vertically into the ground.

Most devices for such purposes are large powered devices mounted on large trucks or cranes for portability. These devices require two or more operators and considerable set-up time. Large powered devices are much too expensive and unwieldy for ordinary metal sign posts, shallow wells and metal fence posts. Rather, the latter are usually driven manually with a sledge hammer or a tripod rig and weight.

With a view toward providing a simple inexpensive light duty powered device for driving sign posts, fence posts and shallow wells, applicant has developed the device disclosed below.

SUMMARY OF THE INVENTION

The new sign post driver comprises a piston which rests upon a post to be driven and a weighted cylinder which reciprocates vertically to impact the piston on the downstroke. The cylinder is raised for each stroke pneumatically and falls by gravity with or without an optional spring assist in the preferred embodiment. Optionally, combustion gas, mechanical or hydraulic power could be employed to raise the cylinder. The new sign post driver employs pneumatic control valves for manual or semi-automatic operation. The reciprocating cylinder is substantially smooth externally, making it less likely to snag an operator or other adjacent workers since workers may be close to the moving cylinder when driving sign posts in particular.

DESCRIPTION OF THE PREFERRED EMBODIMENTS

Figure 1:
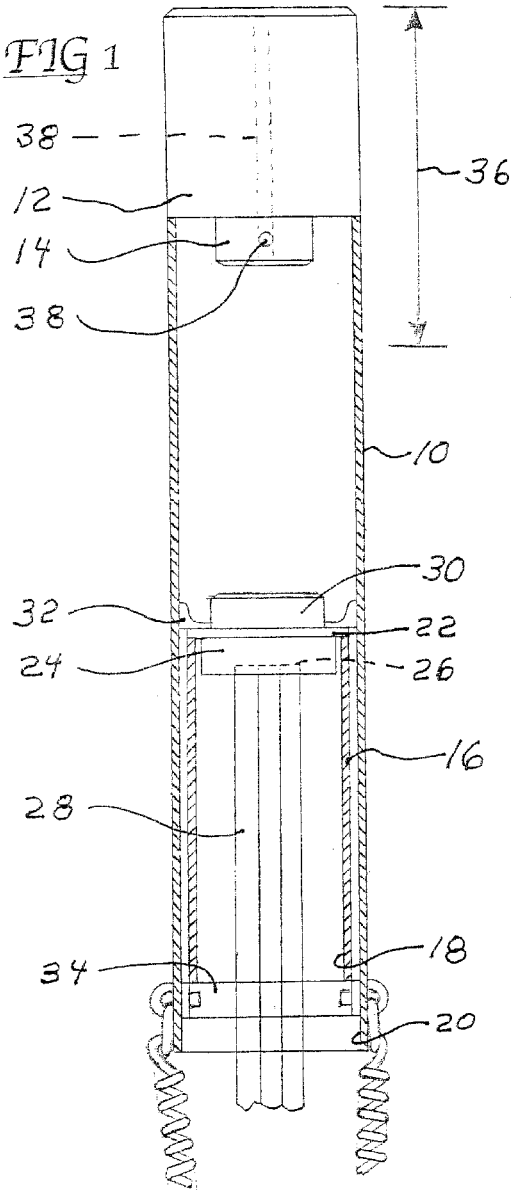
FIG. 1 is a vertical cross-section of the driver in raised position.

In FIG. 1, the new driver comprises a cylindrical sleeve 10 and weighted head 12. The head 12 is built with a suitable heavy material, such as steel, and terminates downwardly with a hammer 14 of hardened steel inside the cylindrical sleeve 10.

The piston 16 within the cylindrical sleeve 10 is open at the lower end 18, as is the sleeve at the lower end 20. Located on the underside of the piston head 22 is a lower anvil 24 with an optional socket 26 therein. The lower anvil 24 accommodates the upper end of an object, such as a sign post 28 to be driven into the ground. Atop the piston head 22 is an upper anvil 30 and an annular piston seal 32. The annular seal 32 engages the inside of the cylindrical sleeve 10 to prevent significant amounts of air from passing between the piston 16 and sleeve. An annular ring 34 is affixed adjacent the lower end 20 of the sleeve 10 to prevent the piston 16 from falling out of the sleeve as the driver is removed from or placed on a post 28.

As the sleeve 10 and head 12 reciprocate 36 relative to the piston 16, the hammer 14 strikes the upper anvil 30 thereby driving the post 28 into the ground.

Figure 2:
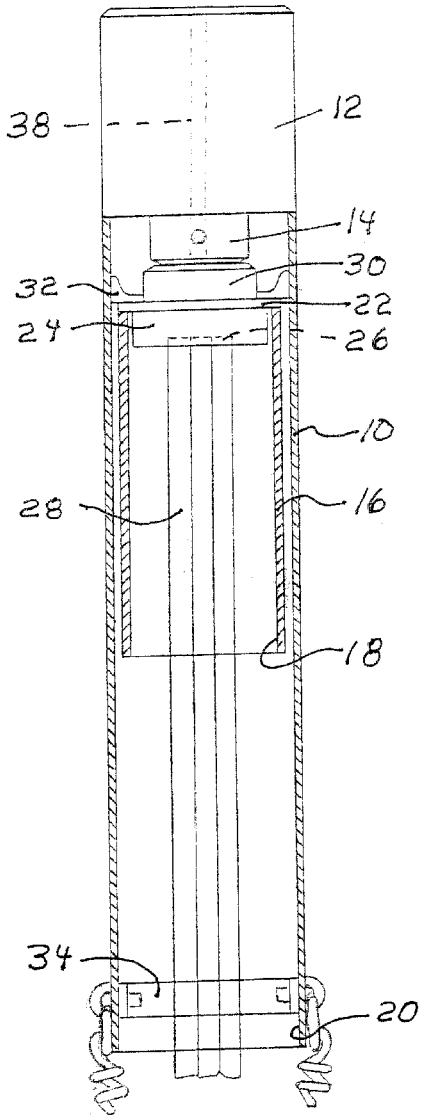
FIG. 2 is a vertical cross-section of the driver in lowered or moment of impact position.
Figure 3:
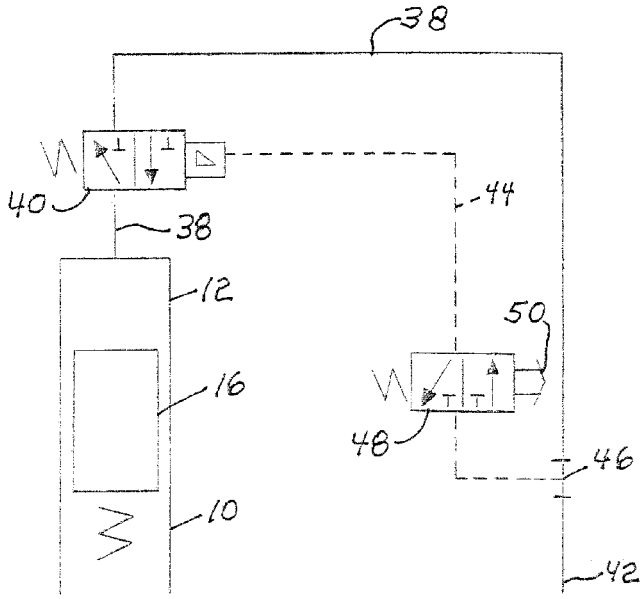
FIG. 3 illustrates a pneumatic circuit for the driver.

In FIG. 3, the cylindrical sleeve 10 and piston 16 are schematically shown with an air line 38 extending through and from the head 12 and hammer 14 (as also shown in FIGS. 1 and 2) through a pilot operated valve 40 and eventually to engage a source of compressed air beyond 42. A pilot air line 44 is tapped into the air line 38 at 46 and extends through a manually operable valve 48 which controls the pilot of the pilot operated valve 40. Thus, whenever the push button 50 on the manually operable valve 48 is pushed, the pilot operated valve 40 shifts to permit compressed air to enter within the cylindrical sleeve 10 and raise the sleeve and head 12. Release of the push button 50 causes the manually operable valve 48 and pilot operated valve 40 to shift back opening the pilot operated valve to exhaust. The cylindrical sleeve 10 and head 12 drop under the influence of gravity, striking the upper anvil 30 and driving the post 28 downward.

As is immediately clear, the new post driver is exceedingly simple in construction and operation and can be made small and light enough for manual lifting and placing upon a fence post, sign post, two-inch well pipe or similar items. A relatively small portable air compressor or the air brake system of a truck can be used as the source of compressed air. The exterior of the cylindrical sleeve 10 can be made smooth and therefore unlikely to snag the user's clothing.

Figure 4:
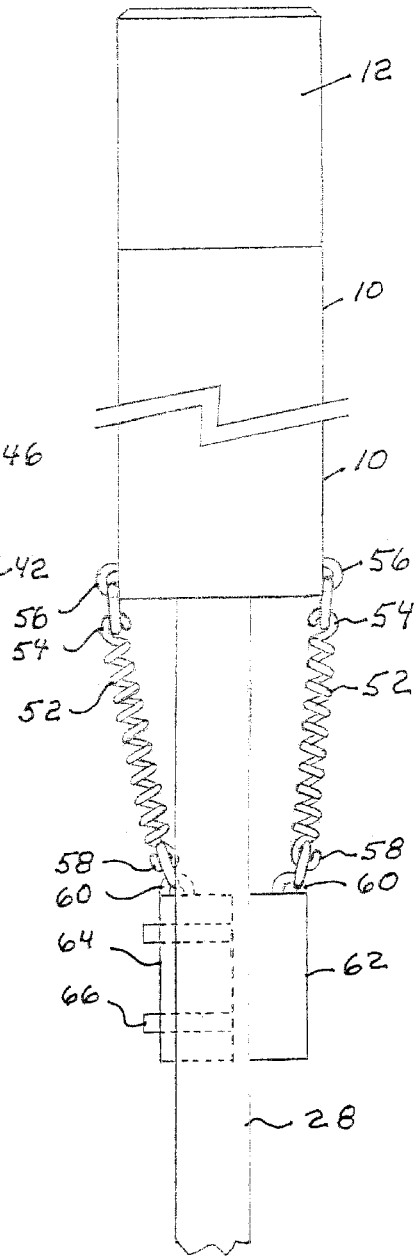
FIG. 4 illustrates an optional spring assist.
Figure 5:
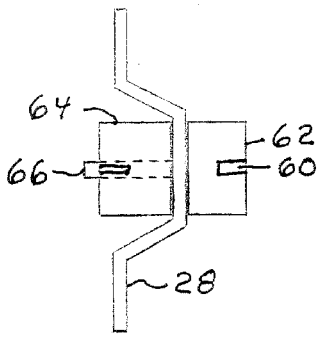
FIG. 5 illustrates a block attachment to a sign post.

In FIG. 4, an optional set of springs 52 are shown. The upper ends 54 of the springs 52 are attached by welded half rings 56 to the lower end 20 of the cylinder 10. The lower ends 58 of the springs 52 are similarly attached to half rings 60 welded to blocks 62 and 64. As shown in FIGS. 4 and 5, the blocks 62 and 64 are attached to the sign post 28 with pins or bolts 66 that pass through holes in the sign post. Sign posts 28 of the shape shown are typically manufactured with holes pre-punched along the entire vertical height. Thus, the blocks 62 and 64 can be positioned to provide a small tension in the springs 52 when the hammer 14 contacts the upper anvil 30. As the cylinder 10 is pneumatically raised, the springs 52 are stretched and thus can thereby add to the downward force subsequently applied to the piston 16 and sign post 28. Thus, the force of the blows on the upper anvil 30 can be increased substantially.

When the post driver is used for piling, fence posts or well pipe and the springs 52 are used, clamps or other attachment devices may be used to attach the springs to the piling, fence post or well pipe.

Although discussed above in terms of a pilot valve 40 and manually operable valve 48, a semi-automatic set of valves may be substituted for repeated cycling of the cylinder 10 merely by holding the push bottom 50 down.

What is claimed is:

1. A pneumatic post driver comprising a piston capable of resting upon the top of a post, a hollow cylinder sealingly engaging the piston and adapted to vertically reciprocate relative to the piston, an upper anvil atop the piston and a hammer within the cylinder, said hammer positioned to strike the upper anvil at the end of the cylinder downstroke, a source of compressed air, means to admit the compressed air into the hollow cylinder thereby raising the hollow cylinder relative to the piston and means to permit exhaust of the compressed air from the hollow cylinder thereby allowing the cylinder to fall suddenly and the hammer to strike the upper anvil.

2. The pneumatic post driver of claim 1, including at least one spring having one end thereof attached to the cylinder and the other end attachable to a post whereby the spring is elongated during the upstroke of the cylinder.

3. The pneumatic post driver of claim 1 wherein the source of compressed air includes a pneumatic circuit having a pilot valve and a manually controllable valve, the pilot valve in pneumatic communication with the manually controllable valve through a pilot line.

4. The pneumatic post driver of claim 1, including a lower anvil on the piston, the lower anvil adapted to engage the post.

5. A compressed gas driver comprising a piston capable of resting upon the top of an object to be driven into the ground, a hollow cylinder sealingly engaging the piston and adapted to vertically reciprocate relative to the piston, means within the hollow cylinder positioned to strike the piston at the end of the cylinder downstroke, means to provide a compressed gas within the hollow cylinder at sufficient pressure to raise the hollow cylinder relative to the piston and means to permit exhaust of the compressed gas from the hollow cylinder thereby allowing the hollow cylinder to fall suddenly and the means within the cylinder to strike the piston.

6. The compressed gas driver of claim 5, including a line communicating from within the hollow cylinder to an external source of compressed gas, and means to control the flow of compressed gas through the line and into the hollow cylinder.

7. The compressed gas driver of claim 6, including manual means to control the flow of compressed gas into the hollow cylinder.

8. The compressed gas driver of claim 5, including at least one spring having one end thereof attached to the cylinder and the other end attachable to the object whereby the spring is elongated during the upstroke of the cylinder.

9. The compressed gas driver of claim 5 having a lower anvil on the piston, the lower anvil having means engageable with the object.

10. The compressed gas driver of claim 5 having a hammer located within the hollow cylinder and an upper anvil on the piston, the hammer being the means to strike the upper anvil on the piston.

11. The compressed gas driver of claim 5, including a generally smooth external surface on the hollow cylinder to minimize snagging of user clothing.

12. The pneumatic post driver of claim 1, including a smooth external surface on the hollow cylinder to minimize snagging of user clothing.

* * * * *